US008670703B2

(12) United States Patent
Mihara

(10) Patent No.: US 8,670,703 B2
(45) Date of Patent: Mar. 11, 2014

(54) IMAGE FORMING APPARATUS, IMAGE FORMING SYSTEM, AND COMPUTER PROGRAM PRODUCT

(75) Inventor: Yasumasa Mihara, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 459 days.

(21) Appl. No.: 12/707,088

(22) Filed: Feb. 17, 2010

(65) Prior Publication Data

US 2010/0239344 A1 Sep. 23, 2010

(30) Foreign Application Priority Data

Mar. 17, 2009 (JP) ..... 2009-065248

(51) Int. Cl.
*G03G 15/00* (2006.01)

(52) U.S. Cl.
USPC ..... 399/389; 399/396

(58) Field of Classification Search
USPC ..... 399/389
See application file for complete search history.

(56) References Cited

U.S. PATENT DOCUMENTS

| | | | | |
|---|---|---|---|---|
| 5,428,459 | A * | 6/1995 | Asai | 358/449 |
| 6,311,039 | B1 * | 10/2001 | Funamizu et al. | 399/394 |
| 7,690,650 | B2 * | 4/2010 | Itoh et al. | 271/263 |
| 7,775,519 | B2 * | 8/2010 | Takahashi et al. | 271/258.01 |
| 7,880,871 | B2 * | 2/2011 | Kazama et al. | 356/139.04 |
| 7,912,384 | B2 * | 3/2011 | Dan | 399/16 |
| 8,072,619 | B2 * | 12/2011 | Fujii et al. | 358/1.12 |
| 2008/0095549 | A1 * | 4/2008 | Yoshizawa | 399/45 |
| 2008/0240832 | A1 * | 10/2008 | Kugimachi | 400/582 |

FOREIGN PATENT DOCUMENTS

| | | |
|---|---|---|
| JP | 2-127058 | 5/1990 |
| JP | 2005-63051 | 3/2005 |
| JP | 2005-352744 | 12/2005 |
| JP | 2008-264399 | 10/2008 |

OTHER PUBLICATIONS

Japanese Office Action dated Mar. 5, 2013, for corresponding Japanese Application No. 2009-065248.

* cited by examiner

*Primary Examiner* — Anthony Nguyen
(74) *Attorney, Agent, or Firm* — Oblon, Spivak, McClelland, Maier & Neustadt, L.L.P.

(57) ABSTRACT

An image forming apparatus receives input of sheet information of a print sheet designated as a print destination of print data by a predetermined information processing apparatus as first sheet information, and stores therein sheet information of a print sheet designated as a print destination in advance by the image forming apparatus as second sheet information. A feed-timing determining unit compares the first sheet information with the second sheet information and determines the feed timing of a print sheet contained in a feed tray in accordance with the comparison result.

4 Claims, 9 Drawing Sheets

IMAGE FORMING APPARATUS, IMAGE FORMING SYSTEM, AND COMPUTER PROGRAM PRODUCT

CROSS-REFERENCE TO RELATED APPLICATIONS

The present application claims priority to and incorporates by reference the entire contents of Japanese Patent Application No. 2009-065248 filed in Japan on Mar. 17, 2009.

BACKGROUND OF THE INVENTION

1. Field of the Invention

The present invention relates to an image forming apparatus, an image forming system, and a computer program product with improved printing speed.

2. Description of the Related Art

Heretofore, an image forming apparatus is known, such as a printer that uses an electrophotographic system, an ink-jet system, a thermal system, or the like, and the apparatus is connected to an information processing apparatus, such as a personal computer (PC) that outputs predetermined print data, and prints out the print data output from the information processing apparatus onto a predetermined print sheet. In recent years, printing speed has been improved in such an image forming apparatus in order to reduce the mental stress of users, or the like.

For example, Japanese Patent Application Laid-open No. 2005-63051 discloses a technology for improving printing speed in an image forming apparatus. In the image forming apparatus disclosed in Japanese Patent Application Laid-open No. 2005-63051, if the rear edge of the print sheet currently being printed is detected by a print-sheet detection sensor, a print sheet for the subsequent page is fed in advance to a predetermined position from a feed tray that holds print sheets. In other words, in the image forming apparatus disclosed in Japanese Patent Application Laid-open No. 2005-63051, the detection of the rear edge of the print sheet is determined as the feed timing of the print sheet for the subsequent page.

However, such a print-sheet detection sensor in an image forming apparatus is arranged at some distance from a feed tray because of structural limitations. As a result, in a conventional image forming apparatus, the interval (hereinafter, referred to as a feed interval) between the print sheet currently being printed and the print sheet that is to be subsequently fed is equivalent to the distance between the print-sheet detection sensor and the feed tray at the shortest; therefore, it is difficult to improve the printing speed by further narrowing the feed interval of the print sheets.

In recent years, in order to further improve printing speed, a technology has been adapted in which the user sets in advance the sheet size, or the like, of the print sheet that is a print destination of print data via a printer driver installed in, for example, a PC, and the feed interval is determined by using the length (hereinafter, referred to as a sheet length) of the print sheet contained in the set sheet size such that the feed interval becomes shorter as the sheet length becomes shorter. Thus, it is possible to feed the print sheet for the subsequent page in advance without waiting for the detection of the rear edge of the print sheet currently being printed, thereby improving the printing speed.

In a conventional image forming apparatus, if, for example, B5 (257 mm×182 mm) size is set by the printer driver, the feed timing is determined by using a sheet length of 257 mm. However, if a print sheet of A4 (297 mm×210 mm) size is to be actually fed from the feed tray as a print sheet for the subsequent page, the print sheet of A4 size is actually fed at the feed timing on the basis of the B5 size; therefore, there is a possibility that a sheet jam is induced.

SUMMARY OF THE INVENTION

It is an object of the present invention to at least partially solve the problems in the conventional technology.

According to an aspect of the present invention, there is provided an image forming apparatus including a feed tray having a space for storing a print sheet that has predetermined current sheet information; a feed unit that picks-up the print sheet contained in the feed tray at a predetermined feed timing; a conveying unit that conveys the print sheet picked-up by the feed unit from the feed tray; a printing unit that performs printing onto the print sheet conveyed by the conveying unit by using print data output from a predetermined information processing apparatus; a discharge tray that is a discharge destination of the print sheet after printing has been performed by the printing unit; an input unit that receives input of sheet information of a print sheet designated as a print destination of the print data by the information processing apparatus as first sheet information; a sheet-information storage unit that stores therein sheet information of a print sheet designated as a print destination in advance by the image forming apparatus as second sheet information; and a feed-timing determining unit that compares the first sheet information with the second sheet information and determines the feed timing in accordance with a comparison result.

According to another aspect of the present invention, there is provided an image forming system including an information processing apparatus that outputs predetermined print data and outputs sheet information of a print sheet designated as a print destination of the print data by the information processing apparatus as first sheet information; and an image forming apparatus. The image forming apparatus includes a feed tray having a space for storing a print sheet that has predetermined current sheet information; a feed unit that picks-up the print sheet contained in the feed tray at a predetermined feed timing; a conveying unit that conveys the print sheet picked-up by the feed unit from the feed tray; a printing unit that performs printing onto the print sheet conveyed by the conveying unit by using print data output from a predetermined information processing apparatus; a discharge tray that is a discharge destination of the print sheet after the printing is performed by the printing unit; an input unit that receives input of the first sheet information output from the information processing apparatus; a sheet-information storage unit that stores therein sheet information of a print sheet designated as a print destination in advance by the image forming apparatus as second sheet information; and a feed-timing determining unit that compares the first sheet information with the second sheet information, thereby determining the feed timing in accordance with a comparison result.

According to still another aspect of the present invention, there is provided a computer program product that includes a computer-readable recording medium that contains a computer program that causes a computer to function as an input unit that receives, as first sheet information, input of sheet information of a print sheet designated by an information processing apparatus that outputs predetermined print data as a print destination of the print data; and a feed-timing determining unit that compares the first sheet information with second sheet information stored in a sheet-information storage unit that stores therein, as the second sheet information, sheet information of a print sheet designated as a print destination in advance by an image forming apparatus, thereby determining a feed timing of a predetermined feed unit that feeds a print sheet contained in a predetermined feed tray in accordance with a comparison result.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments according to the present invention are explained in detail below with reference to the accompanying drawings. The present invention is not limited to these embodiments, and various modified embodiments are allowed without departing from the scope of the present invention.

Figure 1:
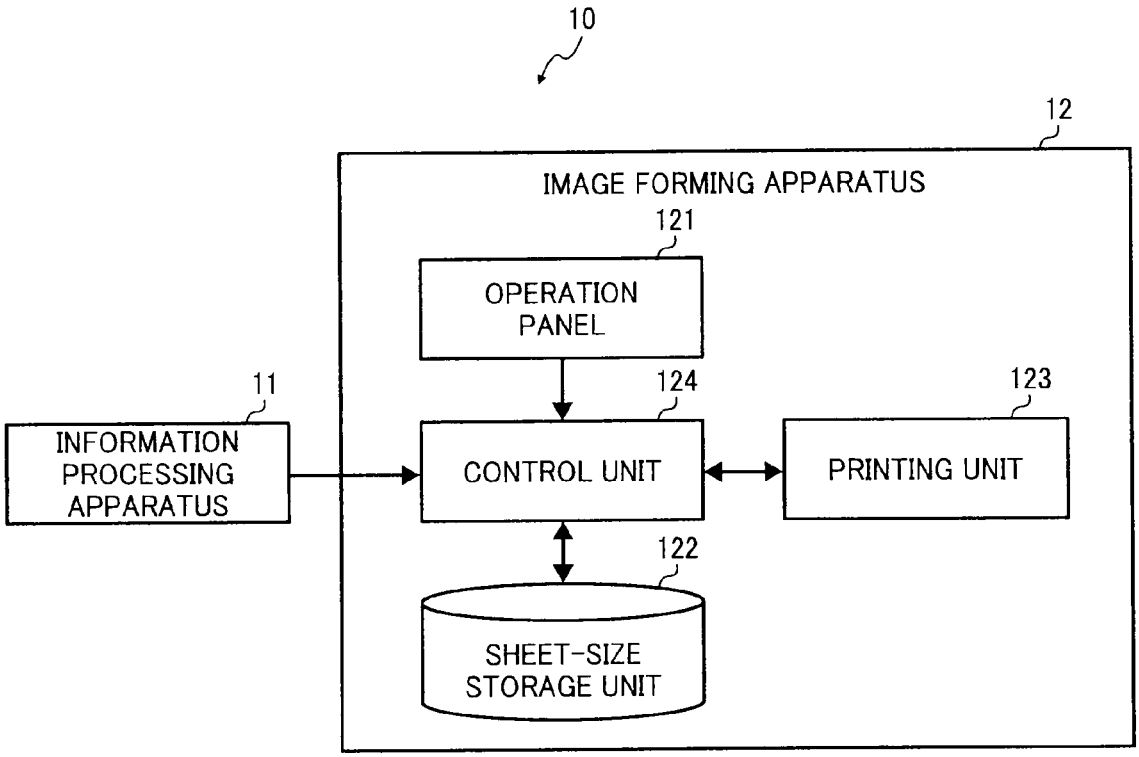
FIG. 1 is a block diagram that schematically illustrates the configuration of an image forming system according to a first embodiment of the present invention.

An explanation will be given of an image forming apparatus and an image forming system according to a first embodiment of the present invention with reference to FIGS. 1 to 7. In the present embodiment, a printer that uses, for example, an electrophotographic system, an ink-jet system, or a thermal system will be explained as an example to which the image forming apparatus is applied. Furthermore, a system that is constituted by a personal computer (PC) and a printer connected to the PC will be explained as an example to which the image forming system is applied. FIG. 1 is a block diagram that schematically illustrates the configuration of the image forming system 10 according to the first embodiment of the present invention. The image forming system 10 includes an information processing apparatus 11 and an image forming apparatus 12 connected to the information processing apparatus 11 via a Universal Serial Bus (USB) or the like.

The information processing apparatus 11 includes general hardware resources (not illustrated), for example, a CPU, a memory, an Input/Output (I/O), or the like. Moreover, general software resources (not illustrated), such as an operating system (OS) such as Windows (registered trademark), a printer driver for operating the image forming apparatus 12, or word-processing software, are installed in the information processing apparatus 11. Upon receiving a print request of data generated by arbitrary software from a user, the information processing apparatus 11 activates the printer driver. Afterwards, arbitrary sheet information (hereinafter, referred to as a first sheet size) is designated by the user via the activated printer driver. The information processing apparatus 11 then outputs the printer data corresponding to the generated data and the first sheet size to the image forming apparatus 12 via the printer driver.

The image forming apparatus 12 includes an operation panel 121, a sheet-size storage unit 122, a printing unit 123, and a control unit 124 and prints out the print data output from the information processing apparatus 11 onto a predetermined print sheet. The operation panel 121 is arranged, for example, on the surface of the image forming apparatus 12, and the user designates arbitrary sheet information (hereinafter, referred to as a second sheet size) via the operation panel 121. The set second sheet size is stored in the sheet-size storage unit 122 by the control unit 124. The printing unit 123 performs a print process under the control of the control unit 124 as described later in detail.

The designation of the first sheet size as described here means that the user designates, via the printer driver, a sheet size that is assumed to be the sheet size of a print sheet held in a feed tray. Furthermore, the designation of the second sheet size as described here means that the user designates, via the operation panel 121, a sheet size that is assumed to be the sheet size of a print sheet held in a feed tray described later. The first sheet size is not necessarily the same as the sheet size of an actual print sheet held in the feed tray. The reason is that arbitrary sheet size can be designated via the printer driver so that there is a possibility that, for example, the user mistakenly designates a sheet size that is different from the sheet size of a print sheet actually contained in the feed tray. Moreover, for the same reason, the second sheet size is not necessarily the same as the sheet size of an actual print sheet held in the feed tray. Furthermore, for the same reason, the first sheet size is not necessarily the same as the second sheet size.

Figure 2:
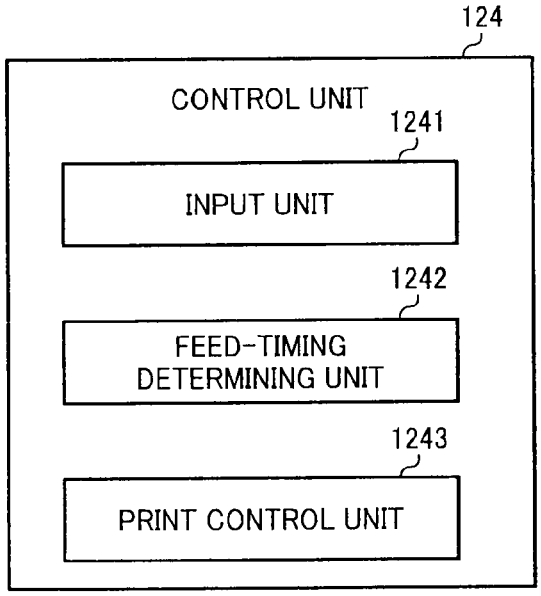
FIG. 2 is a block diagram that schematically illustrates the detailed configuration of a control unit illustrated in FIG. 1.

Next, an explanation will be given of the control unit 124 with reference to FIG. 2. FIG. 2 is a block diagram that schematically illustrates the detailed configuration of the control unit 124. The control unit 124 includes an input unit 1241, a feed-timing determining unit 1242, and a print control unit 1243.

The input unit 1241 receives the input of the print data and the first sheet size output from the information processing apparatus 11. Furthermore, the input unit 1241 receives the input of the second sheet size designated by the user via the operation panel 121 and stores the input second sheet size in the sheet-size storage unit 122. The feed-timing determining unit 1242 performs a feed-timing determining process described later by using the first sheet size and the second sheet size, determines the feed timing of a print sheet contained in the feed tray, and outputs the determined feed timing to the print control unit 1243. The print control unit 1243 performs a print control process described later by using the print data and the feed timing and controls the printing unit 123. As a result, the printing unit 123 prints out the print data onto a print sheet. The feed timing described here determines an interval (hereinafter, referred to as a feed interval) between a print sheet currently being printed and a print sheet (hereinafter, referred to as a subsequent sheet) that is to be fed subsequent to the print sheet and indicates the timing by which the subsequent sheet is to be fed with respect to the previously fed print sheet.

Figure 3:
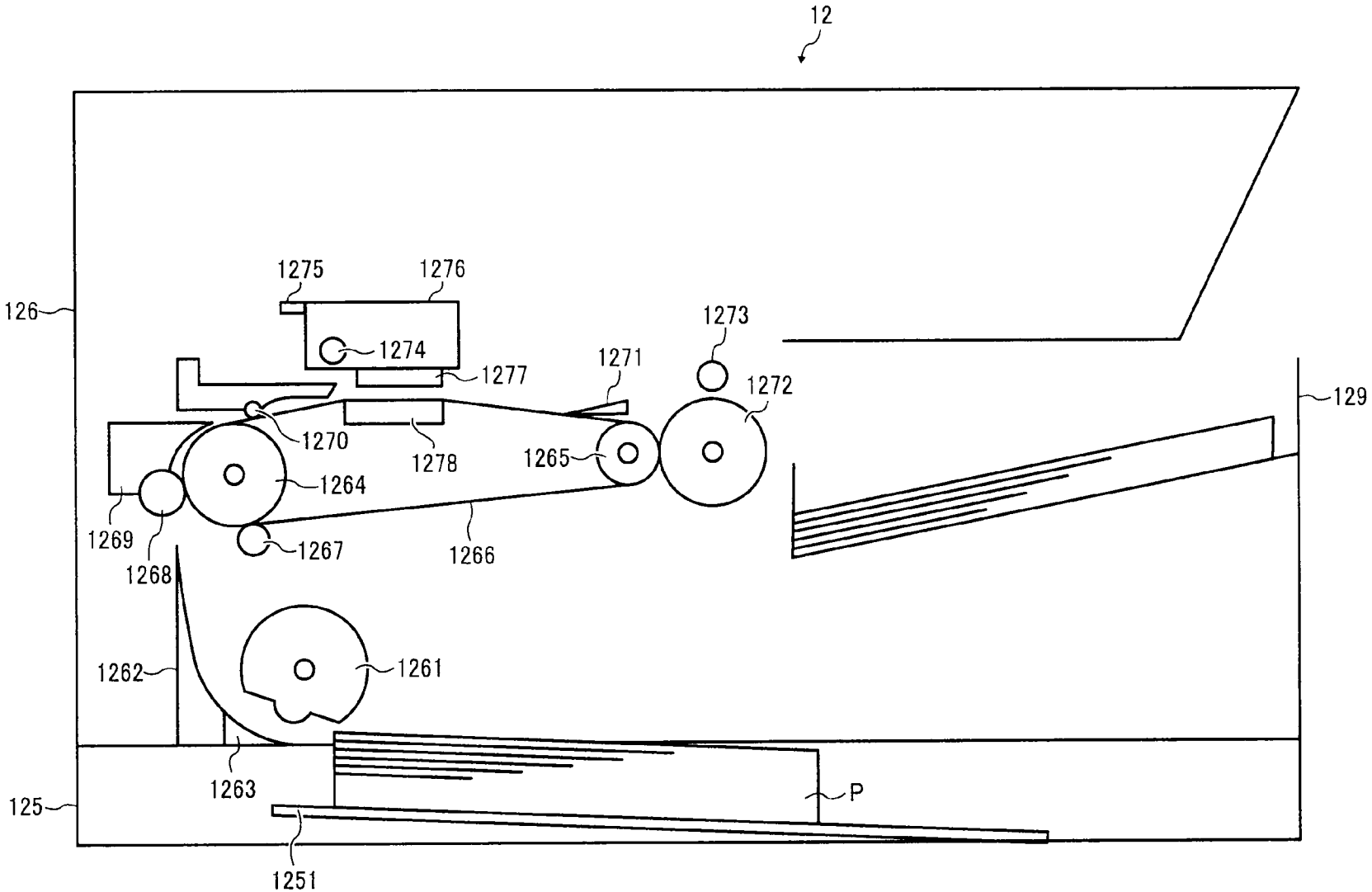
FIG. 3 is a lateral view of internal configuration of an image forming apparatus illustrated in FIG. 1.

Next, a more detailed explanation will be given of the internal configuration of the image forming apparatus 12. FIG. 3 is an internal view that schematically illustrates the configuration of the image forming apparatus 12. For ease of explanation, the operation panel 121, the sheet-size storage unit 122, and the control unit 124 illustrated in FIG. 1 are omitted in FIG. 3. The image forming apparatus 12 has substantially a shape like a chassis and includes a feed tray 125 that is arranged on the bottom, a print unit 126 that is arranged above the feed tray 125 in a vertical direction, and a discharge tray 129 that is arranged above the feed tray 125 in a vertical direction and arranged lateral to the print unit 126 in a horizontal direction.

The feed tray 125 is detachably mounted on the image forming apparatus 12 and holds print sheets P. More specifically, the feed tray 125 includes a sheet stacking section 1251, and the print sheets P are stacked on the sheet stacking section 1251 in a substantially horizontal position. The sheet stacking section 1251 is pushed upwards in a substantially vertical direction by an undepicted spring or the like.

The print unit 126 conveys the print sheet P contained in the feed tray 125 to the discharge tray 129 and performs printing onto the print sheet being conveyed, and the print unit 126 includes a feed roller 1261, a first guide member 1262, a separation pad 1263, a conveying roller 1264, a tension roller 1265, a conveying belt 1266, a charge roller 1267, a counter roller 1268, a second guide member 1269, an end press roller 1270, a separation claw 1271, a discharge roller 1272, a discharge roller 1273, a guide rod 1274, a stay 1275, a carriage 1276, and a recording head 1277.

The feed roller 1261 is arranged above one end of the surface of the print sheet P held in the feed tray 125. The sheet stacking section 1251 is pushed upwards in a substantially vertical direction so that the surface of the print sheet P is brought into contact with the feed roller 1261. The print sheet P, which is in contact with the feed roller 1261, is fed from the feed tray 125 in a direction substantially parallel to the sheet stacking section 1251 due to the rotative force of the feed roller 1261. The feed roller 1261 is connected to an undepicted feed-mechanism drive unit that includes a predetermined drive motor, whereby a predetermined rotative force is applied so that the feed roller 1261 is rotated.

The first guide member 1262 is arranged in the direction to which the print sheet P held in the feed tray 125 is fed. The first guide member 1262 guides the print sheet P fed from the feed tray 125 upwards in a substantially vertical direction.

When the print sheet P is fed from the feed tray 125 toward the first guide member 1262, the print sheet P passes between the feed roller 1261 and the separation pad 1263 that is arranged at a position opposed to the feed roller 1261. The separation pad 1263 has a higher friction coefficient than the friction coefficient between print sheets. Therefore, if two print sheets are concurrently fed from the feed tray 125, the second print sheet is separated from the first print sheet so that only one print sheet is feed at a time to the print unit 126. When the feeding of the first print sheet is completed, the surface of the second print sheet is brought into contact with the feed roller 1261. Thus, a plurality of print sheet held in the feed tray 125 is fed to the print unit 126 one by one.

The conveying roller 1264 is arranged above the first guide member 1262 in a substantially vertical direction, and the tension roller 1265 is arranged on the right side of the conveying roller 1264 in a horizontal direction. The rotation axes of the conveying roller 1264 and the tension roller 1265 are substantially parallel to each other. The conveying belt 1266, which is a ring-shaped endless belt, is placed between the conveying roller 1264 and the tension roller 1265 in a strained state. The width of the conveying belt 1266 is wider than the width of the print sheet P. The direction of the "width" is also defined as the rotation-axis direction of the conveying roller 1264 or the tension roller 1265. On the other hand, the direction of the "length" of the print sheet P in the following descriptions is perpendicular to the direction of the width and is defined as the conveying direction of the print sheet P.

The conveying belt 1266 is moved in the conveying direction (clockwise in FIG. 3) due to the rotative force of the conveying roller 1264, and the like, thereby conveying the print sheet P to the right side in a substantially horizontal direction (hereinafter, referred to as a sub-scanning direction). A component such as the conveying roller 1264 that moves the conveying belt 1266 is connected to an undepicted conveying-belt drive unit that includes a predetermined drive motor, whereby a predetermined rotative force is applied. In the following descriptions, the surface of the conveying belt 1266 means the outer surface of the ring-shaped conveying belt 1266, and the rear surface of the conveying belt 1266 means the inner surface of the ring-shaped conveying belt 1266. Furthermore, the conveyance surface of the conveying belt 1266 means the outer surface of the conveying belt 1266 that conveys the print sheet P and moves to the right side in a substantially horizontal direction.

The conveying belt 1266 is formed of, for example, a pure resin material of about 40 μm on which resistance control is not performed. The surface of the conveying belt 1266 is formed of, for example, an ETFE (thermal-soluble fluorine resin) pure material and functions as a print-sheet sticking surface. Moreover, the rear surface of the conveying belt 1266 is formed of, for example, the same material as the surface, and the resistance control has been performed by using carbon. The conveying roller 1264 is connected to ground and, as a result, the rear surface of the conveying belt 1266 that is in contact with the conveying roller 1264 is also connected to ground.

The charge roller 1267 is arranged near the conveying bell 1266 such that the charge roller 1267 is in contact with the whole area of the conveying belt 1266 in a width direction at a part of the surface of the conveying belt 1266. Furthermore, the charge roller 1267 is arranged such that the charge roller 1267 is rotated in accordance with the movement of the conveying belt 1266. A predetermined pressing force is applied to both ends of the rotation axis of the charge roller 1267 as a pressure force. The charge roller 1267 arranged as described above charges the surface of the conveying belt 1266. More specifically, the charge roller 1267 is connected to an undepicted AC-bias supply unit so that a positive voltage and a negative voltage are alternately supplied by the AC-bias supply unit. As a result, the charge roller 1267 alternately charges the conveying belt 1266 with a positive charge and a negative charge. Thus, a positively-charged band and a negatively-charged band are alternately formed on the surface of the conveying belt 1266 in the moving direction of the conveying belt 1266, whereby it is possible to electrostatically stick the print sheet P to the surface of the conveying belt 1266. The sticking method of the print sheet P is not limited to that described above and, for example, any sticking method, such as a sticking method using a pressure difference between the surface and the rear surface of the conveying belt 1266, can be used.

The counter roller 1268, the second guide member 1269, and the end press roller 1270 are arranged near the conveying roller 1264 above the first guide member 1262 in a substantially vertical direction. Theses components are used for guiding the print sheet P, which has been conveyed by the first guide member 1262 upwards in a substantially vertical direction, in the sub-scanning direction along the conveying belt 1266. More specifically, the print sheet P, which has been guided by the first guide member 1262 upwards in a substantially vertical direction, is sandwiched between the conveying belt 1266 and the counter roller 1268 near the conveying roller 1264 and further conveyed by the counter roller 1268 and the conveying belt 1266 upwards in a substantially vertical direction. Then, the conveyed print sheet P is guided by the second guide member 1269 along the conveying belt 1266, and the edge of the print sheet P is pressed against the conveying belt 1266 by the end press roller 1270. Thus, the print sheet is electrostatically stuck to the conveying belt 1266 in an appropriate manner and conveyed in the sub-scanning direction.

The separation claw 1271, the discharge roller 1272, and the discharge roller 1273 are arranged near the tension roller 1265. More specifically, the separation claw 1271 is arranged above the tension roller 1265 in a substantially vertical direction such that the separation claw 1271 is in contact with the surface of the conveying belt 1266, and the separation claw 1271 separates the printed print sheet P from the conveying belt 1266. The discharge roller 1272 is arranged near the most distal part of the conveying belt 1266 in a conveying direction such that the discharge roller 1272 is substantially parallel to the tension roller. 1265, i.e., the rotation axis of the discharge roller 1272 is substantially parallel to the rotation axis of the tension roller 1265. The discharge roller 1272 is rotated by an undepicted motor, or the like, in the same direction as the tension roller 1265. The print sheet P separated from the conveying belt 1266 passes between the discharge roller 1272 and the discharge roller 1273 and is discharged into the discharge tray 129 due to the rotative force of the discharge roller 1272.

The discharge tray 129 is arranged on the right side of the discharge roller 1272 in a horizontal direction. The print sheet P discharged by the discharge roller 1272 is stacked on the discharge tray 129 in a substantially horizontal position.

The carriage 1276 that is slidable in an extending direction (hereinafter, referred to as a main scanning direction) of the guide rod 1274 and the stay 1275 described later is arranged above the conveyance surface of the conveying belt 1266. The carriage 1276 is connected to an undepicted carriage drive unit that includes a predetermined drive motor, whereby the scanning is performed in the main scanning direction. The recording head 1277 that includes undepicted ink-droplet discharge heads that discharge ink drops is arranged on the carriage 1276 such that the recording head 1277 is opposed to the conveyance surface of the conveying belt 1266. A fourth guide member 1278 is arranged at a position opposed to the recording head 1277 along the conveying belt 1266. The fourth guide member 1278 is arranged such that the upper surface of the fourth guide member 1278 is protruded toward the recording head 1277 from the tangential line that connects the uppermost section of the conveying roller 1264 in a vertical direction and the uppermost section of the tension roller 1265 in a vertical direction, and maintains the flatness of the conveying belt 1266 with high precision.

Figure 4:
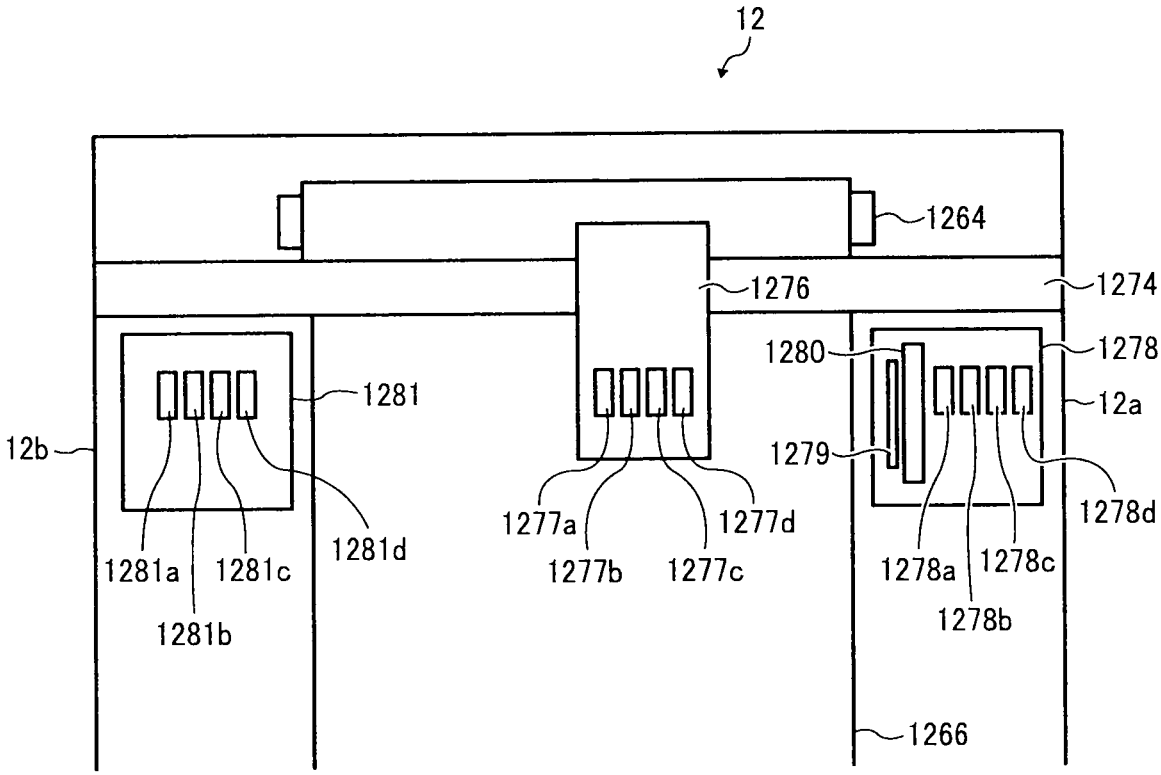
FIG. 4 is a top view of a part of the image forming apparatus illustrated in FIG. 3.

Next, a more detailed explanation will be given of the carriage 1276 with reference to FIG. 4. FIG. 4 is a top view that schematically illustrates the partial configuration of the image forming apparatus 12. In FIG. 4, for ease of explanation, components, such as the discharge roller 1272, for discharging the print sheet are omitted.

The guide rod 1274 that guides the movement of the carriage 1276 in the main scanning direction is laid laterally across side plates 12*a* and 12*b* of the image forming apparatus 12.

Figure 5:
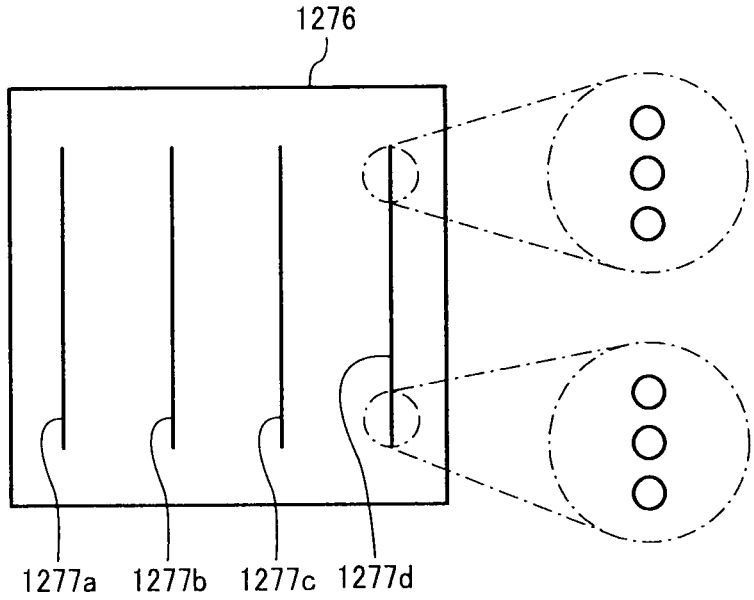
FIG. 5 is a diagram that illustrates an example of nozzles of a recording head.

The recording head 1277 that is arranged on the bottom of the carriage 1276 opposed to the conveying surface of the conveying belt 1266 is constituted by a recording head 1277*a* that includes an ink-droplet discharge nozzle that discharges ink drops of a yellow (Y) color, a recording head 1277*b* that includes an ink-droplet discharge nozzle that discharges ink drops of a cyan (C) color, a recording head 1277*c* that includes an ink-droplet discharge nozzle that discharges ink drops of a magenta (M) color, and a recording head 1277*d* that includes an ink-droplet discharge nozzle that discharges ink drops of a black (Bk) color. The recording heads 1277*a* to 1277*d* are adjacently arranged in the main scanning direction on the bottom of the carriage 1276, and the ink-drop discharge direction of each of the ink-droplet discharge nozzles is a direction toward the conveying surface of the conveying belt 1266. For example, as illustrated in FIG. 5, each of the ink-droplet discharge nozzles may be configured by a plurality of nozzles.

The recording heads 1277*a* to 1277*d* include, as an undepicted recording-head drive unit, a component that generates a predetermined pressure to discharge the ink drops as well as a driver IC that drives the component. Such components that generate the pressure include a piezoelectric actuator such as a piezoelectric element, a thermal actuator that uses the phase transition due to film boiling of fluid by using an electrothermal conversion element such as a heating resistance element, a shape-memory-alloy actuator that uses the metallic phase transition due to a temperature change, or an actuator that uses an electrostatic force. If the recording heads 1277*a* to 1277*d* are concurrently driven, there may be a case where the recording quality level is decreased due to an influence of crosstalk among the recording heads 1277*a* to 1277*d* or a high current is temporarily required. Therefore, in the present embodiment, it is possible to drive the recording heads 1277*a* to 1277*d* at different times from one another.

An undepicted sub-tank in which the color inks discharged from the respective recording heads 1277*a* to 1277*d* are contained is mounted on the carriage 1276. Furthermore, the sub-tank is refilled by an ink cartridge mounted on a cartridge loaded section arranged at a predetermined position of the image forming apparatus 12 via an undepicted ink feed tube. An undepicted feed pump, and the like, for sending the ink to the sub-tank are arranged on the cartridge loaded section.

A maintenance mechanism 1278 is arranged on a non-print area on one side of the carriage 1276 in the scanning direction. The maintenance mechanism 1278 includes cap members 1278*a* to 1278*d* for capping the respective ink-droplet discharge nozzle surfaces of the recording head 1277, a wiper blade 1279 that is a blade member for wiping the ink-droplet discharge nozzle surfaces, and a flushing-discharge receiver 1280 that receives the ink drops when the flushing discharge is performed to discharge the ink with an increased viscosity thereby discharging the ink drops that do not contribute to the recording. The carriage 1276 is moved in the main scanning direction and arranged at a position opposed to the maintenance mechanism 1273, for example, while standing by to print. Then, the ink-droplet discharge nozzle surfaces are capped by the cap members 1278*a* to 1278*d*, respectively. Thus, it is possible to maintain each of the ink-droplet discharge nozzles in a moist state and prevent the discharge failure of the ink due to the drying of the ink. During the capping, the ink drops may be sucked up from each of the ink-droplet discharge nozzles by using an undepicted suction pump whereby the ink drops with an increased viscosity or air bubbles are discharged. Furthermore, for example, the ink drops that do not contribute to printing may be discharged by flushing before the printing starts or during the printing. The waste liquid of the ink caused by the above-described maintenance operation, the ink discharged into the caps 1278*a* to 1278*d*, the ink attached to the wiper blade 1279 and removed by a wiper cleaner, or the ink discharged by flushing into the flushing-discharge receiver 1280 are collected and stored in an undepicted waste-liquid tank.

A flushing-discharge receiver 1281 that receives the ink drops when the flushing discharge is performed to discharge the ink drops that do not contribute to recording, thereby discharging the recording liquid with an increased viscosity during printing, or the like, is arranged on a non-print area on the other side of the carriage 1276 in the scanning direction. Openings 1281*a* to 1281*d* that correspond to the respective recording heads 1277*a* to 1277*d* are arranged on the flushing-discharge receiver 1281.

The image forming apparatus 12 may include an undepicted duplex unit in a removable manner. The duplex unit allows printing on both sides of the print sheet P. More specifically, the duplex unit takes the print sheet P picked up from the print unit 126 due to the inverse rotation of the conveying belt 1266, inverts the print sheet so that printing can be performed again on the back side of the printed surface, and feeds the print sheet to the print unit 126 again. Moreover, the image forming apparatus 12 may include a fan, or the like, and a configuration may be such that the temperature within the apparatus is decreased by starting up the fan.

Next, an explanation will be given of the print process performed by the image forming apparatus 12 in view of the above-described configuration. The undepicted feed-mechanism drive unit, the conveying-belt drive unit, the carriage drive unit, the recording-head drive unit, and the like, as described above, constitute the printing unit 123 illustrated in FIG. 1, and these components are controlled by the print control unit 1243. The print control unit 1243 controls the feed-mechanism drive unit in accordance with a print request from the user and, as a result, the print sheet P held in the feed tray 125 is fed from the feed tray 125 to the print unit 126. Furthermore, the print control unit 1243 controls the conveying-belt drive unit, the carriage drive unit, the recording-head drive unit, and the like, and, as a result, the movement of the carriage 1276 in the main scanning direction, the discharge of the ink from the recording head 1277, and the like, are performed. More specifically, under the control of the print control unit 1243, the ink drops are discharged onto the stopped print sheet P so that the printing is performed on one line of the print sheet P, and, afterwards, the print sheet P is conveyed for a predetermined distance so that the printing is performed on the next line of the print sheet P. Thus, the printing is performed on the print sheet P. Moreover, the print control unit 1243 controls the feed-mechanism drive unit in accordance with the feed timing determined by the feed-timing determining unit 1242 and, as a result, the subsequent sheet held in the feed tray 125 is fed to the print unit 126 at a predetermined feed timing described later.

Figure 6:
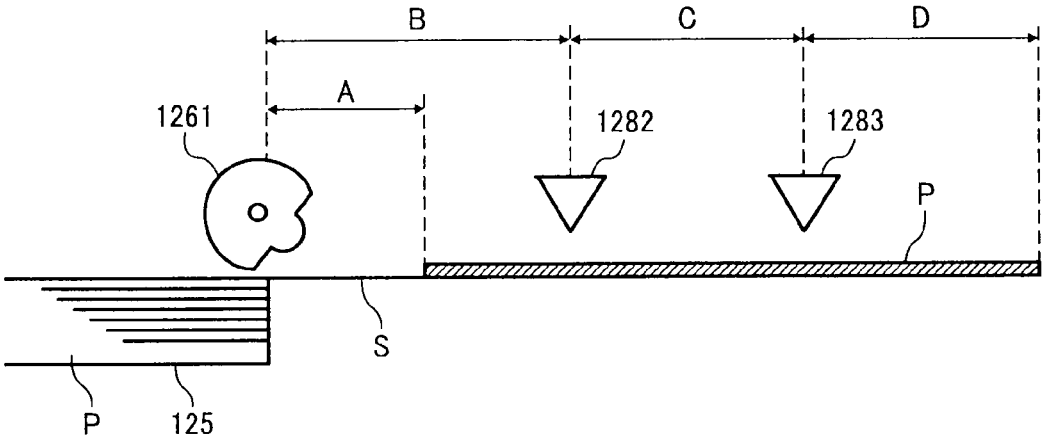
FIG. 6 is an explanatory diagram for explaining a feeding timing.

Next, an explanation will be given of the feed timing of the print sheet held in the feed tray 125. FIG. 6 is an explanatory diagram that explains the feeding of the print sheet P. In FIG. 6, the reference mark S indicates a virtual conveying path of the print sheet P. Although the actual conveying path of the print sheet P variously extends toward the substantially vertical direction or the substantially horizontal direction as illustrated in FIG. 3, it is illustrated in a linear fashion for ease of explanation. Furthermore, in FIG. 6, the reference numeral 1282 indicates a rear-edge sensor that detects the rear edge of a print sheet, and the reference numeral 1283 indicates a registration sensor that detects the edge of a print sheet, thereby detecting a start timing of the printing. For ease of explanation, these components are omitted in FIG. 3.

In a conventional image forming apparatus, the detection of the rear edge of the print sheet by the rear-edge sensor 1282 is determined as the feed timing, and the feeding of the subsequent sheet is started when the rear edge of the previously fed print sheet is detected. However, in this manner, the previously fed print sheet and the subsequent sheet are located apart from each other for a distance between the feed roller 1261 and the rear-edge sensor 1282; therefore, it is difficult to set the feed interval less than the distance between the feed roller 1261 and the rear-edge sensor 1282. Although, in theory, it is possible to reduce this distance by arranging the rear-edge sensor 1282 at a position close to the feed roller 1261, it is actually difficult to arrange the rear-edge sensor 1282 at a position close to the feed roller 1261 because of the structure of the image forming apparatus.

Therefore, it is known that, when the edge of the previously fed print sheet is detected by the registration sensor 1283, a feed distance Dist is calculated in accordance with following Equation (1) and, after the print sheet is conveyed for the calculated feed distance Dist, the feeding of the subsequent print sheet is started so that the feed interval is reduced.

$$\text{Dist}=E+A-C-B \tag{1}$$

In Equation (1), E is the length (hereinafter, referred to as a sheet length) of a print sheet in the conveying direction, A is the desired feed interval on the conveying path, C is the distance between the rear-edge sensor 1282 and the registration sensor 1283 on the conveying path, and B is the distance from the feed roller 1261 to the rear-edge sensor 1282 on the conveying path.

In the above-described image forming apparatus, when the feed distance Dist is calculated, it is required to substitute the sheet length of the print sheet into Equation (1), where such a sheet length usually corresponds to a sheet size, or the like, designated by the user via a printer driver installed in an information processing apparatus, such as a PC, connected to the image forming apparatus. However, in such an image forming apparatus, because the feed timing is computed by using only the sheet length designated on the side of the information processing apparatus, a failure such as a sheet jam is induced. For example, it is assumed that, on the side of the information processing apparatus, a print request of print data on a plurality of print sheets is received via the printer driver and, at the same time, the print sheet of B5 size is designated as the print destination of the print data. On the other hand, it is assumed that, on the side of the image forming apparatus, for example, print sheets of B5 size and A4 size are held in the feed tray in a mixed manner, and print sheets of B5 size are fed as the first few pages of the actually fed print sheets while a print sheet of A4 size is fed during the printing. In this case, the image forming apparatus computes the feed timing on the basis of the B5 size although the print sheet of A4 size actually starts to be fed during the printing; therefore, the feed interval between the previously fed print sheet of B5 size and the subsequently fed print sheet of A4 size is narrower than necessary or the subsequent sheet is fed in a state where there is no feed interval, whereby a sheet jam is induced.

Therefore, in the image forming system 10 according to the present embodiment, the feed timing of the subsequent sheet is determined in consideration of the second sheet size designated by the image forming apparatus 12 in addition to the first sheet size designated by the information processing apparatus 11. Thus, it is possible to maintain the improvement of the printing speed while preventing the occurrence of a sheet jam.

Figure 7:
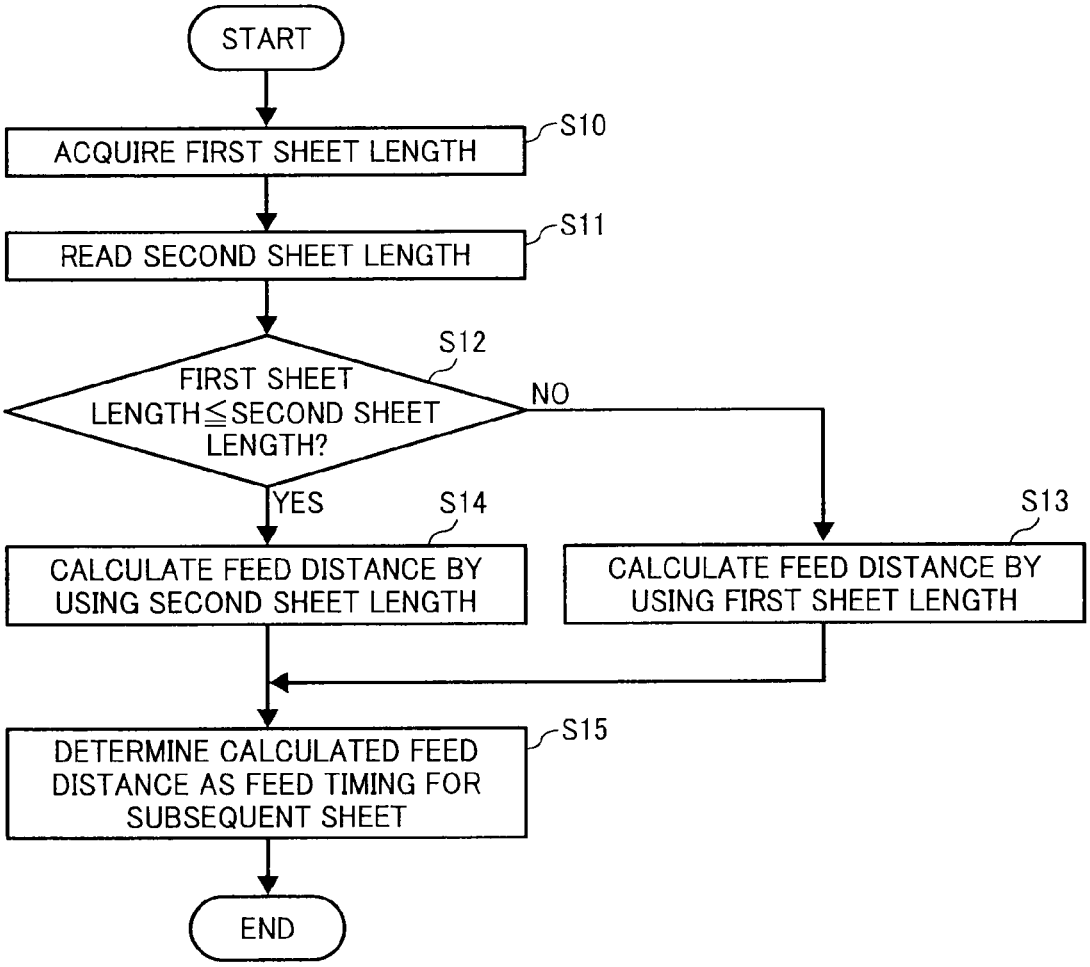
FIG. 7 is a flowchart of a feed-timing determining process according to the first embodiment.

Next, an explanation will be given of the feed-timing determining process performed by the feed-timing determining unit 1242 according to the first embodiment. FIG. 7 is a flowchart of the feed-timing determining process. When the input unit 1241 receives the input of the first sheet size, the feed-timing determining unit 1242 acquires the first sheet length from the first sheet size (Step S10). Furthermore, the feed-timing determining unit 1242 refers to the sheet-size storage unit 122 and reads the second sheet length from the second sheet size stored in the sheet-size storage unit 122 (Step S11).

Next, the feed-timing determining unit 1242 compares the first sheet length with the second sheet length and determines whether the first sheet length is equal to or smaller than the second sheet length (Step S12). As a result, if the feed-timing determining unit 1242 determines that the first sheet length is not equal to or smaller than the second sheet length (No at Step S12), the feed-timing determining unit 1242 computes the feed timing by using the first sheet length (Step S13). Conversely, if the feed-timing determining unit 1242 determines that the first sheet length is equal to or smaller than the second sheet length (Yes at Step S12), the feed-timing determining unit 1242 computes the feed timing by using the second sheet length (Step S14). The feed-timing determining unit 1242 then determines the computed feed timing as the feed timing of the subsequent sheet after the process at Step S13 or Step S14 (Step S15). Thus, the feed-timing determining process by the feed-timing determining unit 1242 is completed.

The computing of the feed timing by using the sheet length described here means, for example, the computing of the feed timing using above-described Equation (1). More specifically, for example, if the feed timing is computed by using the first sheet length at Step S13, the first sheet length is substituted into the sheet length E in Equation (1) so that the feed distance Dist is calculated. Furthermore, for example, if the feed timing is computed by using the second sheet length at Step S14, the second sheet length is substituted into the sheet length E in Equation (1) so that the feed distance Dist is calculated. That is to say, the computed feed timing corresponds to the feed distance Dist calculated by using Equation (1).

When the feed timing is determined at Step S15, the print control unit 1243 determines whether the registration sensor 1283 has detected the feed timing. More specifically, the print control unit 1243 determines whether the registration sensor 1283 has detected the feed distance Dist. If the print control unit 1243 determines that the registration sensor 1283 has detected the feed distance Dist, the print control unit 1243 controls the feed-mechanism drive unit, thereby starting the feeding of the subsequent sheet.

As described above, according to the first embodiment, the feed timing of the subsequent sheet is determined by using the longer one of the sheet length designated by the information processing apparatus and the sheet length designated by the image forming apparatus. Thus, it is possible to prevent a sheet jam due to the difference between the sheet size of the print sheet actually fed as the subsequent sheet and the sheet size used for determining the feed timing.

Figure 8:
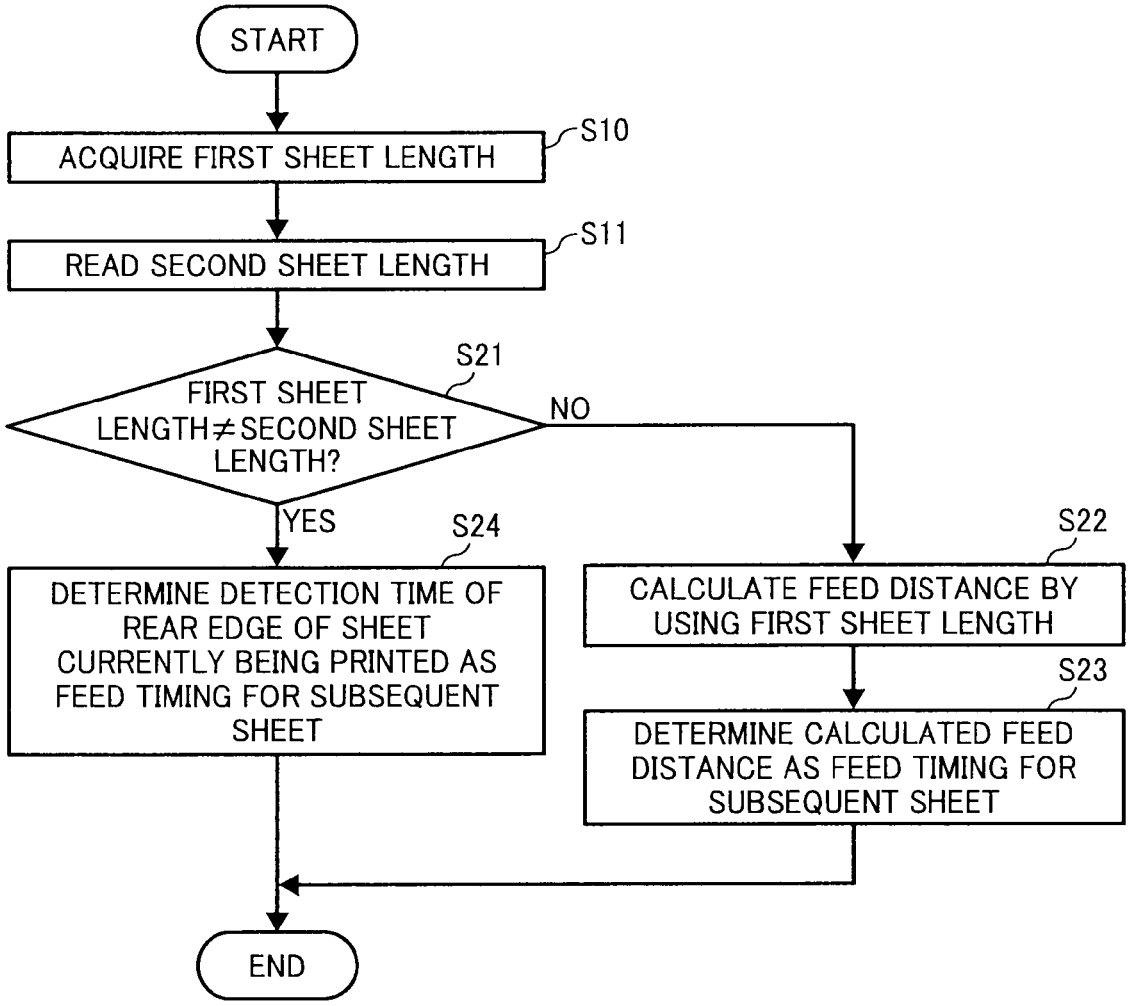
FIG. 8 is a flowchart of a feed-timing determining process according to a second embodiment of the present invention.

Next, an explanation will be given of an image forming apparatus and an image forming system according to a second embodiment of the present invention with reference to FIG. 8. The image forming apparatus and the image forming system according to the second embodiment are different from the image forming apparatus and the image forming system according to the first embodiment only in the feed-timing determining process performed by the feed-timing determining unit. Therefore, the components to which the same names and reference numerals as those in the first embodiment are assigned have the same configuration and functions as those in the first embodiment unless otherwise mentioned in particular below.

The feed-timing determining unit 1242 determines whether the first sheet length is identical to the second sheet length after the process at Step S11 (Step S21). As a result, if the feed-timing determining unit 1242 determines that the first sheet length is identical to the second sheet length (No at Step S21), the feed-timing determining unit 1242 computes the feed timing by using the first sheet length (Step S22) and determines the computed feed timing as the feed timing of the subsequent sheet (Step S23). Thus, the feed-timing determining process is terminated.

Conversely, if the feed-timing determining unit 1242 determines that the first sheet length is not identical to the second sheet length as a result of the process at Step S21 (Yes at Step S21), the feed-timing determining unit 1242 determines the detection time of the rear edge of the print sheet by the rear-edge sensor 1282 as the feed timing of the subsequent sheet (Step S24). Thus, the feed-timing determining process is terminated.

Afterwards, if the feed timing is determined at Step S23, the print control unit 1243 determines whether the feed distance Dist has passed by using the registration sensor 1283 and controls the feed-mechanism drive unit so that the feeding of the subsequent sheet is started when the feed distance Dist has passed. On the other hand, if the feed timing is determined at Step S24, the print control unit 1243 determines whether the rear edge of the print sheet currently being printed is detected by the rear-edge sensor 1282 and controls the feed-mechanism drive unit so that the feeding of the subsequent sheet is started when the rear edge is detected.

As described above, according to the second embodiment, if the first sheet length is different from the second sheet length, it is determined that there is a possibility that a sheet jam is produced due to the feed timing being based on the sheet lengths designated by the information processing apparatus and the image forming apparatus, and the detection time of the rear edge of the print sheet is determined as the feed timing of the subsequent sheet. Thus, it is possible to prevent a failure such as a sheet jam.

Figure 9:
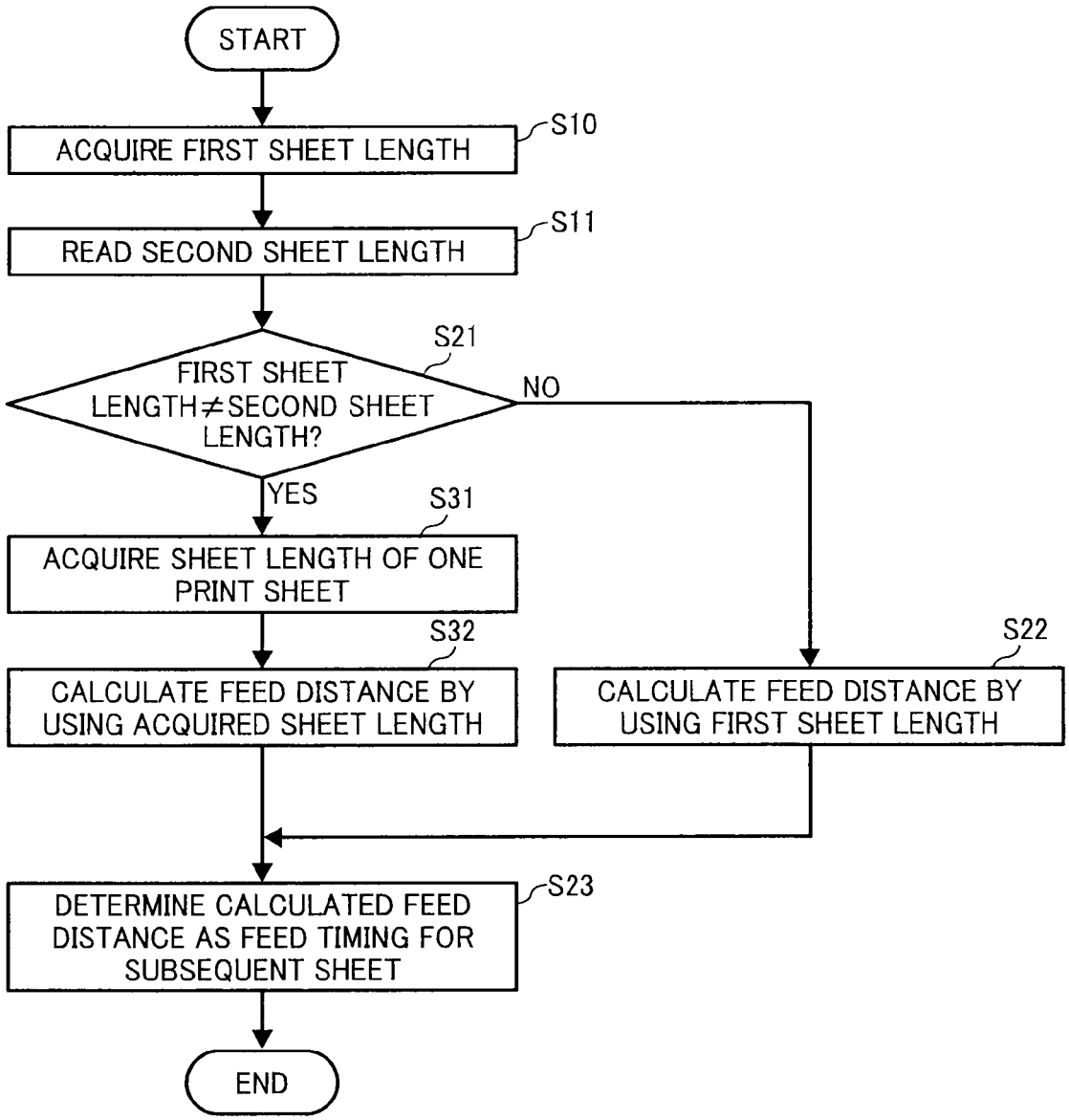
FIG. 9 is a flowchart of a feed-timing determining process according to a third embodiment of the present invention.

Next, an explanation will be given of an image forming apparatus and an image forming system according to a third embodiment of the present invention with reference to FIG. 9. The image forming apparatus and the image forming system according to the third embodiment are different from the image forming apparatuses and the image forming systems according to the first and second embodiments in only the feed-timing determining process performed by the feed-timing determining unit. Therefore, the components to which the same names and reference numerals as those in the first and second embodiments are assigned have the same configuration and functions as those in the first and second embodiments unless otherwise mentioned in particular below.

If the feed-timing determining unit 1242 determines that the first sheet length is different from the second sheet length as a result of the process at Step S21 (Yes at Step S21), the feed-timing determining unit 1242 acquires the sheet length of the print sheet (Step S31). The acquisition of the print length described here means that the sheet length of the print sheet in a conveying direction is acquired by a predetermined sheet-length detection sensor arranged on the conveying path of the print sheet. In this case, the feed-timing determining unit 1242 controls the feed-mechanism drive unit and the conveying-belt drive unit, thereby causing one print sheet to de fed and conveyed. As a result, the sheet-length detection sensor detects the leading edge and the rear edge of the print sheet being conveyed and acquires the sheet length. If the entire print sheet passes by the sheet-length detection sensor so that the leading edge and the rear edge of the print sheet are detected and the sheet length is detected in accordance with the detection result, the feed-timing determining unit 1242 computes the feed timing by using the sheet length (Step S32). Afterwards, the feed-timing determining unit 1242 determines the computed feed timing as the feed timing of the subsequent sheet (Step S23). Thus, the feed-timing determining process is terminated.

In the same manner as the print control unit 1243 according to the first and second embodiments, if the feed timing is determined at Step S23, the print control unit 1243 determines whether the feed distance Dist has passed by using the registration sensor 1283 and controls the feed-mechanism drive unit so that the feeding of the subsequent sheet is started when the feed distance Dist has passed.

As described above, according to the third embodiment, if the first sheet length is different from the second sheet length, it is determined that there is a possibility that a sheet jam is induced due to the feed timing being based on the sheet lengths designated by the information processing apparatus and the image forming apparatus and, after the sheet length of the actual print sheet contained in the feed tray is acquired, the feed timing of the subsequent sheet is determined by using the acquired sheet length. Thus, it is possible to remedy a failure such as a sheet jam.

Figure 10:
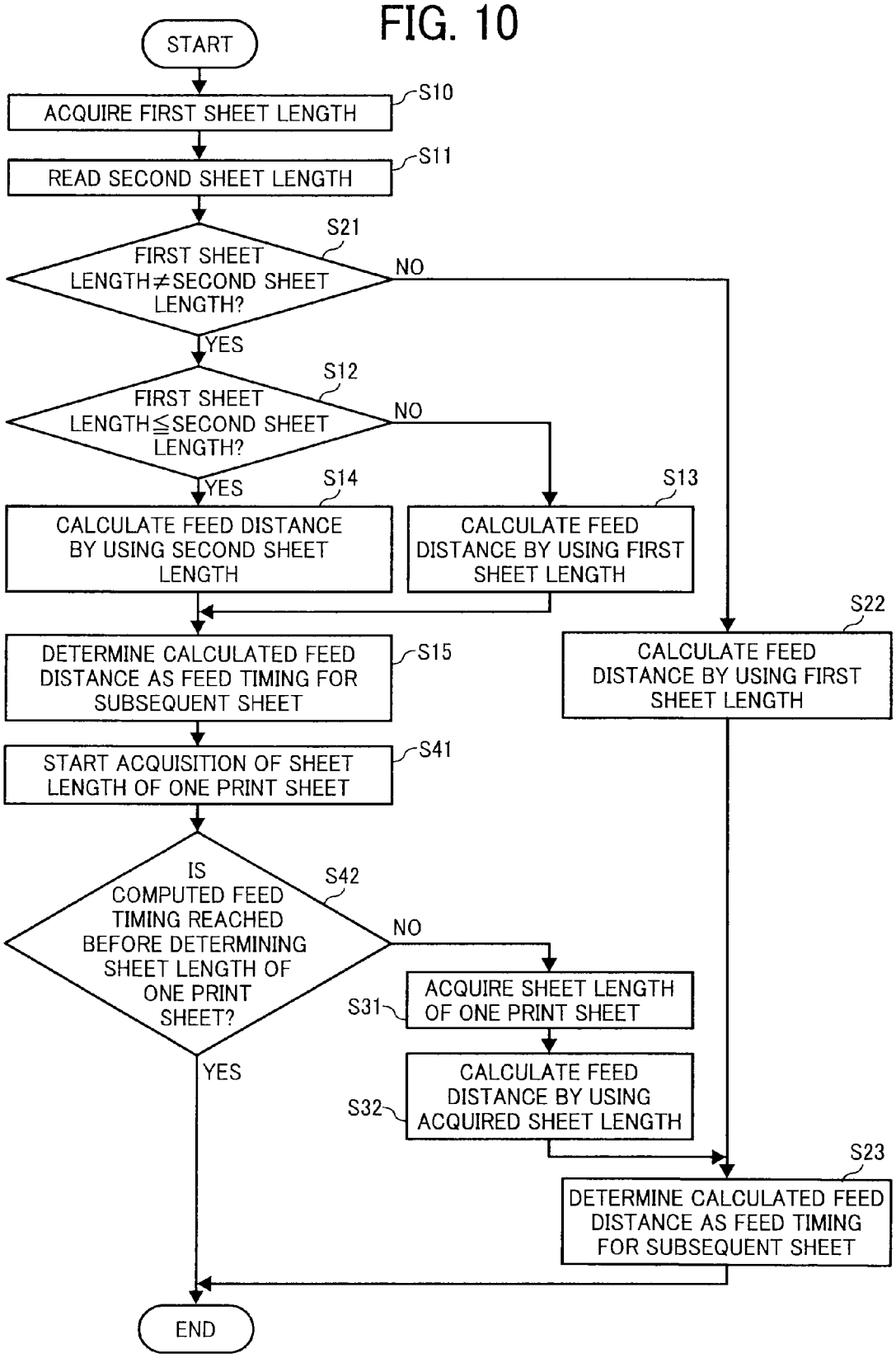
FIG. 10 is a flowchart of a feed-timing determining process according to a fourth embodiment of the present invention.

An explanation will be given of an image forming apparatus and an image forming system according to a fourth embodiment of the present invention with reference to FIG. 10. The image forming apparatus and the image forming system according to the fourth embodiment are different from the image forming apparatuses and the image forming systems according to the first to third embodiments in only the feed-timing determining process performed by the feed-timing determining unit. Therefore, the components to which the same names and reference numerals as those in the first to third embodiments are assigned have the same configuration and functions as those in the first to third embodiments unless otherwise mentioned in particular below.

If the feed-timing determining unit 1242 determines that the first sheet length is different from the second sheet length as a result of the process at Step S21 (Yes at Step S21), the feed-timing determining unit 1242 performs the process from Step S12 to Step S15 and determines the feed timing by using the longer one of the first sheet length and the second sheet length. The feed-timing determining unit 1242 then requests the print control unit 1243 to start to acquire the sheet length of one print sheet. As a result, the print control unit 1243 starts to detect the sheet length of one print sheet by using the feed-mechanism drive unit, the conveying-belt drive unit, and the sheet-length detection sensor in the same manner as the third embodiment (Step S41).

Afterwards, the feed-timing determining unit 1242 determines whether the determined feed timing is reached white acquiring the sheet length of one print sheet (Step S42). More specifically, the feed-timing determining unit 1242 determines whether the registration sensor 1283 has detected the feed distance Dist calculated at Step S14 or Step S15 while acquiring the sheet length of one print sheet. As a result, if the feed-timing determining unit 1242 determines that the computed feed timing is not reached before determining the sheet length of one print sheet, that is to say, while acquiring the sheet length of one print sheet (No at Step S42), the feed-timing determining unit 1242 continues to acquire the sheet length, thereby determining the sheet length (Step S31). The feed-timing determining unit 1242 then calculates the feed distance by using the acquired sheet length (Step S32), determines the calculated feed distance as the feed timing of the subsequent sheet (Step S23), and terminates the feed-timing determining process. Conversely, if the feed-timing determining unit 1242 determines that the feed distance is reached before determining the sheet length of one print sheet (Yes at Step S42), the feed-timing determining unit 1242 terminates the feed-timing determining process.

The print control unit 1243 determines whether the feed distance Dist has passed by using the registration sensor 1283 as a result of the feed-timing determining process in the same manner as the print control unit 1243 according to the first to third embodiments and controls the feed-mechanism drive unit so that the feeding of the subsequent sheet is started when the feed distance Dist has passed.

As described above, according to the fourth embodiment, if the first sheet length is different from the second sheet length, it is determined whether the feed timing being based on the longer one of the first sheet length and the second sheet length is reached before the sheet length of one print sheet is determined. If the feed timing is reached before the sheet length is determined, the feeding is started in accordance with the feed timing. Thus, a failure such as a sheet jam can be remedied while the print sheet can be sequentially fed.

Figure 11:
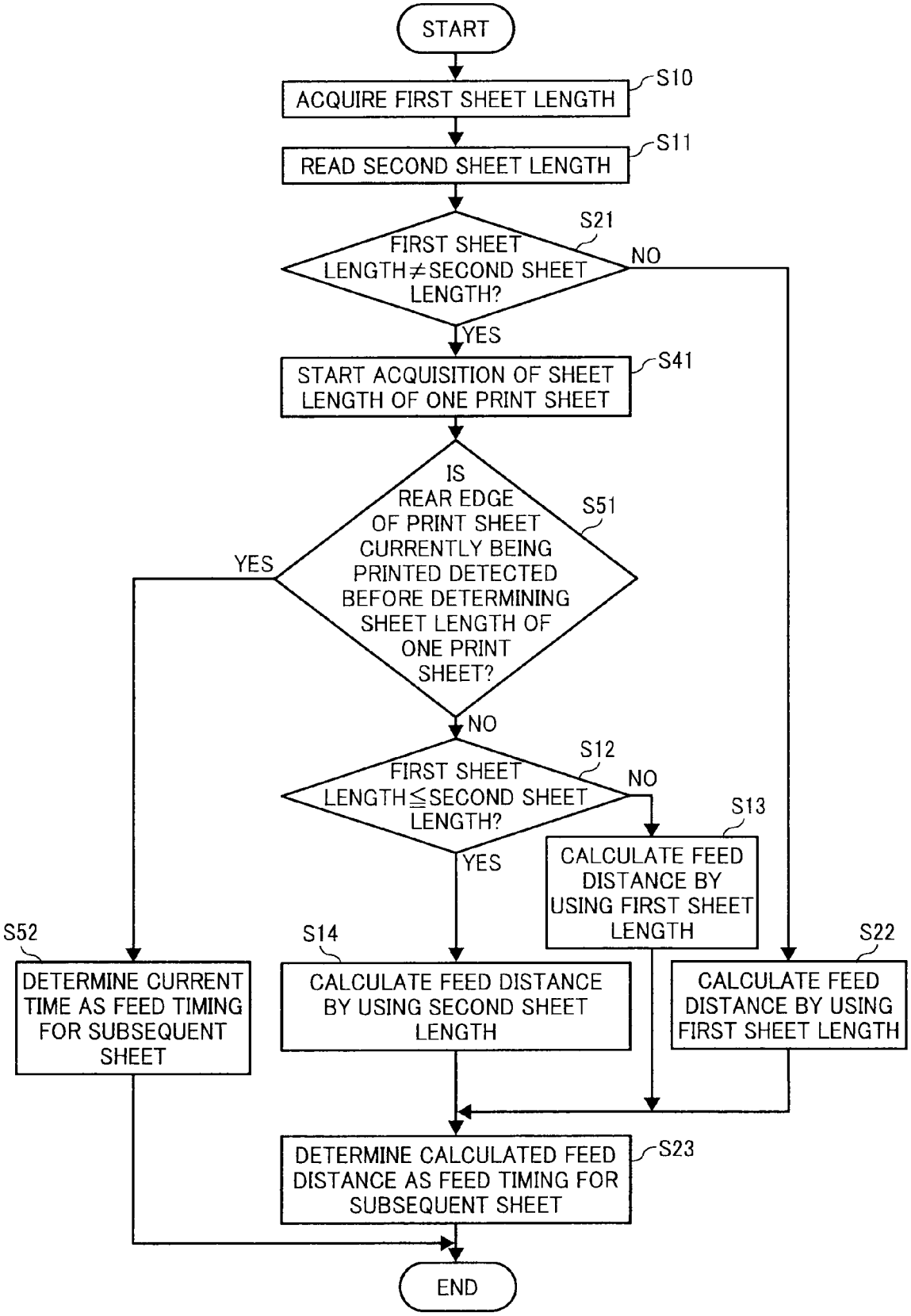
FIG. 11 is a flowchart of a feed-timing determining process according to a fifth embodiment of the present invention.

Next, an explanation will be given of an image forming apparatus and an image forming system according to a fifth embodiment of the present invention with reference to FIG. 11. The image forming apparatus and the image forming system according to the fifth embodiment are different from the image forming apparatuses and the image forming systems according to the first to fourth embodiments only in the feed-timing determining process performed by the feed-timing determining unit. Therefore, the components to which the same names and reference numerals as those in the first to fourth embodiments are assigned have the same configuration and functions as those in the first to fourth embodiments unless otherwise mentioned in particular below.

If the feed-timing determining unit 1242 starts to acquire the sheet length of one print sheet (Step S41), the feed-timing determining unit 1242 determines whether the rear edge of the print sheet currently being printed is detected by the rear-edge sensor 1282 before the acquisition of the sheet length of one print sheet is completed or before the sheet length is determined (Step S51). As a result, if the feed-timing determining unit 1242 determines that the rear edge is detected before the acquisition of the sheet length of one print sheet is completed or before the sheet length is determined (Yes at Step S51), the feed-timing determining unit 1242 determines the time when the rear edge is detected (i.e., the current time) as the feed timing of the subsequent sheet (Step S52) and terminates the feed-timing determining process. Conversely, if the feed-timing determining unit 1242 determines that the rear edge is not detected before the acquisition of the sheet length of one print sheet is completed or before the sheet length is determined (No at Step S51), the feed-timing determining unit 1242 calculates the feed distance by using the longer one of the first sheet length and the second sheet length (Steps S12 to S14), determines the feed timing by using the calculated feed distance (Step S23), and terminates the feed-timing determining process.

Afterwards, the print control unit 1243 determines whether the feed distance Dist has passed by using the registration sensor 1283 when the feed timing is determined in the same manner as the print control unit 1243 according to the first to fourth embodiments and controls the feed-mechanism drive unit so that the feeding of the subsequent sheet is started when the feed distance Dist has passed.

As described above, according to the fifth embodiment, if the first sheet length is different from the second sheet length, the sheet length of one print sheet is acquired and, while the sheet length is acquired, it is determined whether the rear edge of the print sheet is detected. Then, if it is determined that the rear edge of the print sheet is detected while the sheet length is acquired, the feeding of the subsequent sheet is immediately started. Thus, a failure such as a sheet jam can be remedied while the print sheet can be sequentially fed.

Although the feed distance is calculated by using the first sheet length if the first sheet length is identical to the second sheet length according to the second to fifth embodiments, the feed distance may be calculated by using the second sheet length.

Furthermore, although the sheet length of one print sheet is acquired by the sheet-length detection sensor arranged on the conveying path according to the third to fifth embodiments, instead of this, a sheet-width detection sensor that acquires the sheet width of one print sheet may be arranged on the conveying path. Usually, the horizontal and vertical lengths of a print sheet are uniquely defined with respect to each other; for example, the horizontal and vertical lengths of a print sheet of A4 size have a relation of 297 mm×210 mm, and the horizontal and vertical lengths of a print sheet of B5 size have a relation of 257 mm×182 mm. Therefore, if the sheet size of the actually fed print sheet is, for example, A4 (297 mm×210 mm) and it longitudinal direction is the conveying direction, the sheet-width detection sensor detects a sheet width of 210 mm, recognizes a sheet length of 297 mm on the basis of the detected sheet width, and calculates the feed distance by using the recognized sheet length. Thus, the feed timing can be determined by using the sheet width. Such a sheet-width detection sensor may be arranged on a carriage. In this case, the sheet-width detection sensor detects both ends of the sheet width of the print sheet in accordance with the main scanning of the carriage, thereby detecting the sheet width.

Moreover, although the image forming apparatus and the information processing apparatus are connected to each other via a USB in the image forming systems according to the first to fifth embodiments, they may be connected via various wired/wireless, for example, a Local Area Network (LAN), Bluetooth (registered trademark), or the like.

Furthermore, although a system that includes a printer and a PC connected to the printer is explained in the first to fifth embodiments as an example to which the image forming system is applied, it is also useful for a system that includes an arbitrary apparatus, such as a scanner or a facsimile machine, that performs continuous printing, a portable terminal that outputs predetermined print data and is connected to the arbitrary apparatus, and the like. Moreover, the image forming apparatuses according to the first to fifth embodiments can be applied to a multifunction product, or the like, that has at least any two functions of a copy function, a scanner function, and a facsimile function in addition to the printer function.

Moreover, although the first sheet size is designated via the printer driver and the second sheet size is set via the operation panel in the image forming systems according to the first to fifth embodiments, the first sheet length may be designated via the printer driver or the second sheet length may be designated via the operation panel. Furthermore, the sheet width may be designated instead of the sheet length. In this case, the feed-timing determining process is performed by identifying the sheet length corresponding to the sheet width.

Furthermore, the feed timing may be determined by using any sheet information, for example, the type of a sheet, or the like, in addition to the first sheet size and the second sheet size in the image forming systems according to the first to fifth embodiments. Thus, the sheet information can be determined in a comprehensive manner and a sheet jam can be prevented.

Furthermore, it may be selectable as to whether the feed-timing determining process is to be performed via the printer driver by the operation of a check box, a pull-down menu, or the like, in the image forming systems according to the first to fifth embodiments. If the setting is specified such that the feed-timing determining process is not to be performed, the image forming apparatus performs the normal feed timing such that, for example, the detection time of the rear edge of the print sheet is determined as the feed timing.

Furthermore, although the second sheet size designated by the user via the operation panel is stored in the sheet-size storage unit in the image forming systems according to the first to fifth embodiments, the size of an actual sheet that, is detected by an arbitrary component, for example, a sheet-length detection sensor, or the like, and contained in the feed tray may be stored.

An image forming program executed by the image forming apparatus 12 according to the first to fifth embodiments is installed and provided in a read-only memory (ROM), or the like. Such an image forming program has a module configuration that includes the above-described units (the input unit and the feed-timing determining unit) and, as actual hardware, the central processing unit (CPU) reads the image forming program from a storage medium such as the ROM and executes the read image forming program to load the respective units into a main storage device so that the input unit and the feed-timing determining unit are generated on the main storage device. A print program for performing the print process by the image forming apparatus 12 according to the first to fifth embodiments is stored in an undepicted storage medium such as an HDD. Such a print program has a module configuration that includes the above-described print control unit and, as actual hardware, the CPU reads the print program from a storage medium such as the HDD and executes the read print program to load the print control unit into a main storage device so that the print control unit is generated on the main storage device.

Figure 12:
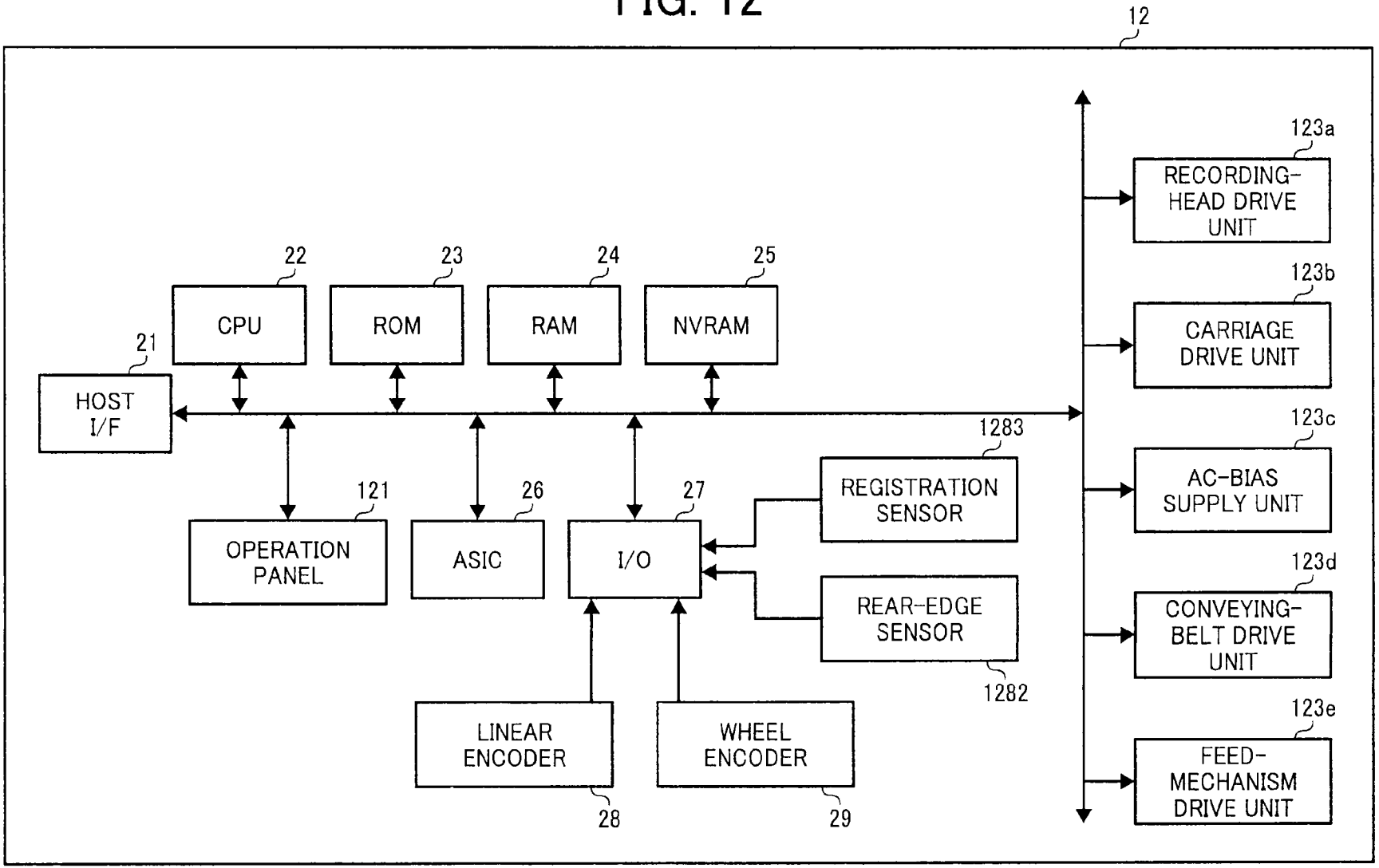
FIG. 12 is a block diagram that schematically illustrates the hardware configuration of image forming apparatuses according to the first to fifth embodiments.

In the following descriptions, a more detailed explanation will be given of the hardware configuration of the image forming apparatus 12 according to the first to fifth embodiments with reference to FIG. 12. FIG. 12 is a block diagram that illustrates the hardware configuration of the image forming apparatus 12 according to the first to fifth embodiments. The image forming apparatus 12 includes a controller constituted by a host interface (I/F) 21, a CPU 22, a read-only memory (ROM) 23, a RAM 24, a non volatile random access memory (NVRAM) 25, the operation panel 121, an application specific integrated circuit (ASIC) 26, an input/output (I/O) 27, a linear encoder 28, a wheel encoder 29, the rear-edge sensor 1282, and the registration sensor 1283, and a printing unit constituted by a recording-head drive unit 123*a*, a carriage drive unit 123*b*, an AC-bias supply unit 123*c*, a conveying-belt drive unit 123*d*, and a feed-mechanism drive unit 123*e*. The printing unit constituted by the recording-head drive unit 123*a*, and the like, corresponds to the printing unit 123 illustrated in FIG. 1. In FIG. 12, components, such as the conveying belt and the feed tray illustrated in FIG. 3, and the like, are omitted.

The controller and the printing unit are connected to each other via, for example, a peripheral component interface (PCI) bus. The controller is a controller that controls the entire image forming apparatus 12 and controls the drawing, the communication, and the input from the operation panel 121. The printing unit is a printer engine, or the like, that is connectable to the PCI bus and may include an engine necessary for performing the scanner function, an engine necessary for performing an image processing function, such as error diffusion or gamma conversion, or the like, in addition to the recording-head drive unit 123*a*, and the like.

The host I/F 21 is connected to an undepicted information processing apparatus and receives input of first sheet information and print data output from the information processing apparatus.

The CPU 22 controls the entire image forming apparatus 12 and loads various programs stored in the ROM 23 onto the RAM 24 for execution. As a result, the CPU 22 functions as the input unit 1241, the feed-timing determining unit 1242, or the print control unit 1243 according to the first to fifth embodiments and performs control of the feeding of a print sheet in accordance with a predetermined feed timing and the movement of the recording head. More specifically, the CPU 22 executes the image forming program to generate the feed-timing determining unit and determines the feed timing by using the generated feed-timing determining unit. Furthermore, the CPU 22 executes the print program to generate the print control unit and controls the recording-head drive unit 123*a*, the carriage drive unit 123*b*, the AC-bias supply unit 123*c*, the conveying-belt drive unit 123*d*, and the feed-mechanism drive unit 123*e* by using the generated print control unit. As a result, printing on the print sheet is performed. Moreover, the CPU 22 controls the feed-mechanism drive unit 123*e* in accordance with the determined feed timing by using the generated print control unit. Thus, the feeding of the subsequent sheet can be performed at a predetermined feed timing.

The ROM 23 is a read only memory used as a memory for storing various programs, such as the image forming program, and data. The RAM 24 is a writable and readable memory used as a memory for expanding the programs and data read from the ROM 23, a memory for drawing of a printer, or the like.

The NVRAM 25 is a rewritable nonvolatile memory and can store therein data while the power of the image forming apparatus 12 is turned off. The sheet-size storage unit according to the first to fifth embodiments corresponds to the NVRAM 25.

The ASIC 26 processes input/output signals to control the entire apparatus for a print process to perform various types of signal processing, sorting, or the like, on print data, and others.

The I/O 27 receives the input from the linear encoder 28, the wheel encoder 29, the rear-edge sensor 1282, and the registration sensor 1283. The linear encoder 28 and the wheel encoder 29 detect the current position of the carriage with respect to the print sheet, thereby allowing printing at a desired position.

An explanation will be given of the print process performed by the image forming apparatus 12 in view of the above-described configuration of the image forming apparatus 12. The CPU 22 reads and analyzes the print data received by the host I/F 21. Afterwards, the ASIC 26 performs predetermined image processing, a data sorting process, or the like, on the print data. Next, the CPU 22 generates image data by using the print data, a drive waveform constituted by one drive pulse or a plurality of drive pulses, or the like, at a desired timing and outputs it to the recording-head drive unit 123*a* or the carriage drive unit 123*b*. Although the generation of dot pattern data for image output is performed by the printer driver according to the present embodiment, for example, font data may be stored in the ROM 23 to generate it or the image data may be expanded into bit map data by the printer driver and transferred to the image forming apparatus 12.

Afterwards, the recording-head drive unit 123*a* drives the recording head by selectively applying, to the recording head, the drive pulses that constitute the drive waveform generated by the CPU 22 in accordance with the dot pattern data that is serially input and corresponds to one line of the recording head. The recording-head drive unit 123*a* includes, for example, a shift register to which clock signals and serial data that is image data are input, a latch circuit that latches the registration value of the shift register by using latch signals, a level converting circuit that changes the level of the output value of the latch circuit, an analog switch array that is controlled to be turned on/off by the level converting circuit, and the like, and a desired drive pulse contained in the drive waveform is selectively applied to the recording head by controlling to turn on/off the analog switch array. Thus, the printing onto a print sheet is performed in cooperation with the drive of the conveying belt by the conveying-belt drive unit 123*d*.

A configuration may be such that the image forming program executed by the image forming apparatuses according to the first to fifth embodiments is stored and provided, in a form of a file that is installable and executable, in a recording medium readable by the computer, such as a CD-ROM, a flexible disk (FD), a CD-R, a digital versatile disk (DVD), or the like.

Furthermore, a configuration may be such that the image forming program executed by the image forming apparatuses according to the first to fifth embodiments is stored in another computer connected to the computer via a network, such as the Internet, and provided by being downloaded to the computer via the network. Furthermore, a configuration may be such that the image forming program executed by the image forming apparatus according to the present embodiment is provided or distributed via a network such as the Internet. Thus, it is possible to deal with the program version upgrade (i.e., running change).

According to various aspects of the present invention, an advantage is produced such that the printing speed can be improved in addition to preventing occurrence of a sheet jam.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus configured to be connected to an information processing apparatus that outputs print data, the image forming apparatus comprising:

a feed tray having a space for storing a print sheet that has predetermined current sheet information;

a feed unit configured to pick-up the print sheet contained in the feed tray at a predetermined feed timing;

a conveying unit configured to convey the print sheet picked-up by the feed unit from the feed tray;

a printing unit configured to perform printing onto the print sheet conveyed by the conveying unit by using the print data output from the information processing apparatus;

a discharge tray configured to be a discharge destination of the print sheet after printing has been performed by the printing unit;

an input unit configured to receive, as part of a print request of the print data that is received from a user at the information processing apparatus, input of a first sheet length, along a conveying direction of the conveying unit, of a print sheet designated as a print destination of the print data from an active printer driver of the information processing apparatus;

a sheet-information storage unit configured to store, in advance and independent of the input unit receiving the print request of the print data, an input of a second sheet length, along the conveying direction of the conveying unit, of a print sheet designated as a print destination, the second sheet length being received as an input by a user at an operation panel of the image forming apparatus; and a feed-timing determining unit configured to compare the first sheet length with the second sheet length and determine the feed timing in accordance with a comparison result, wherein the feed-timing determining unit determines the feed timing in accordance with the first sheet length when the first sheet length is greater than and not equal to the second sheet length, and determines the feed timing in accordance with the second sheet length when the first sheet length is shorter than or equal to the second sheet length.

2. The image forming apparatus according to claim 1, further comprising a sheet-information detecting unit that detects current sheet information, wherein if the first sheet length is different from the second sheet length and if a feed timing determined by using the longer one of the first sheet length and the second sheet length is not reached while the sheet-information detecting unit detects the current sheet information, the feed-timing determining unit determines the feed timing by using the current sheet information detected by the sheet-information detecting unit.

3. An image forming system comprising:

an information processing apparatus that outputs predetermined print data and outputs sheet information of a print sheet designated as a print destination of the print data by the information processing apparatus as first sheet information; and an image forming apparatus, configured to be connected to the information processing apparatus and that outputs the print data, that includes a feed tray having a space for storing a print sheet that has predetermined current sheet information;

a feed unit configured to pick-up the print sheet contained in the feed tray at a predetermined feed timing;

a conveying unit configured to convey the print sheet picked-up by the feed unit from the feed tray;

a printing unit printing onto the print sheet conveyed by the conveying unit by using print data output from a predetermined information processing apparatus;

a discharge tray configured to be a discharge destination of the print sheet after the printing is performed by the printing unit;

an input unit configured to receive, as part of a print request of the print data that is received from a user at the information processing apparatus, input of a first sheet length, along a conveying direction of the conveying unit, of a print sheet designated as a print destination of the print data from an active printer driver of the information processing apparatus;

a sheet-information storage unit configured to store, in advance and independent of the input unit receiving the print request of the print data, an input of a second sheet length, along the conveying direction of the conveying unit of a print sheet designated as a print destination, the second sheet length being received as an input by a user at an operation panel of the image forming apparatus; and a feed-timing determining unit configured to compare the first sheet length with the second sheet length, thereby determining the feed timing in accordance with a comparison result, wherein the feed-timing determining unit determines the feed timing in accordance with the first sheet length when the first sheet length is greater than and not equal to the second sheet length, and determines the feed timing in accordance with the second sheet length when the first sheet length is shorter than or equal to the second sheet length.

4. A computer-readable recording medium that contains a computer program that causes a computer to function as an input unit configured to receive, as part of a print request of print data that is received from a user at an information processing apparatus, input of a first sheet length, along a conveying direction of a conveying unit of an image forming apparatus, of a print sheet designated as a print destination of the print data from an active printer driver of the information processing apparatus;

a sheet-information storage unit configured to store, in advance and independent of the input unit receiving the print request of the print data, an input of a second sheet length, along the conveying direction of the conveying unit, of a print sheet designated as a print destination, the second sheet length being received as an input by a user at an operation panel of the image forming apparatus; and a feed-timing determining unit configured to compare the first sheet length with the second sheet length and determine the feed timing in accordance with a comparison result, wherein the feed-timing determining unit determines the feed timing in accordance with the first sheet length when the first sheet length is greater than and not equal to the second sheet length, and determines the feed timing in accordance with the second sheet length when the first sheet length is shorter than or equal to the second sheet length.

* * * * *